United States Patent [19]

Ueno

[11] Patent Number: 5,040,376

[45] Date of Patent: Aug. 20, 1991

[54] AIR-CONDITIONING APPARATUS HAVING INDOOR UNITS CONNECTED TO ONE OUTDOOR UNIT VIA ONE BRANCH UNIT

[75] Inventor: Kiyotaka Ueno, Shizuoka, Japan

[73] Assignee: Kabushiki Kaisha Toshiba, Kawasaki, Japan

[21] Appl. No.: 636,300

[22] Filed: Dec. 31, 1990

[30] Foreign Application Priority Data

Feb. 23, 1990 [JP] Japan ..... 2-40906

[51] Int. Cl.[5] ..... F25B 13/00

[52] U.S. Cl. ..... 62/160; 62/324.6; 165/22

[58] Field of Search ..... 62/160, 117, 324.6; 165/22

[56] References Cited

U.S. PATENT DOCUMENTS 4,878,357 11/1989 Sekigami et al. ..... 62/160

FOREIGN PATENT DOCUMENTS 0057346 5/1979 Japan ..... 62/324.6
61-45145 10/1986 Japan .
1-57061 3/1989 Japan .

*Primary Examiner*—William E. Wayner
*Attorney, Agent, or Firm*—Cushman, Darby & Cushman

[57] ABSTRACT

In an air-conditioning apparatus, a plurality of two-way valves are provided, in a branch unit, for controlling a flow of a refrigerant into a respective indoor heat exchanger and a direction in which the refrigerant is flowed into the indoor heat exchanger. The two-way valve is connected in parallel with a corresponding one of a plurality of bypasses having a flow resistance. Upon the opening of the one or more two-way valves, a corresponding bypass or bypasses are previously placed in fluid communication.

12 Claims, 10 Drawing Sheets

AIR-CONDITIONING APPARATUS HAVING INDOOR UNITS CONNECTED TO ONE OUTDOOR UNIT VIA ONE BRANCH UNIT

BACKGROUND OF THE INVENTION

1. Field of the Invention

The present invention relates to a multi-type air-conditioning apparatus including a plurality of indoor units.

2. Description of the Related Art

A multi-type air-conditioning apparatus is known which includes one outdoor unit and plurality of indoor units to provide a heat pump type refrigerating apparatus.

The air-conditioning apparatus can conveniently cool or heat a plurality of rooms at a time in a house or a building.

In a building having a computer room or a building having a perimeter zone or an interior zone, however, upon a request of a cooling mode from one location a request or requests for a heating mode are sometimes made from an other location or locations.

In such a situation, one of the cooling and heating modes cannot be performed in preference to the other.

For this reason, even if a better circumstance is obtained at that location, an occupant or occupants at the other location or locations feel uncomfortable or an apparatus, such as a computer, may sometimes fail.

Such inconvenience is often experienced in the spring and autumn times not only in the building but also a common house having a plurality of rooms.

An air-conditioning apparatus has emerged on the market which can simultaneously perform a cooling and a heating mode in a plurality of indoor units.

For example, Published Unexamined Japanese Patent Application 61-45145 discloses an air-conditioning apparatus including one outdoor unit having a compressor and outdoor heat exchanger and a plurality of indoor units connected to the outdoor unit and having an indoor heat exchanger each and adapted to, when at least one of the plurality of indoor units is operated in a cooling mode. operate at least one of the remaining indoor units in a heating mode.

Published Unexamined Japanese Patent Application 64-57061 discloses an air-conditioning apparatus including one outdoor unit having a compressor and outdoor heat exchanger and a plurality of indoor units connected to the outdoor unit via a multi-control unit and having an indoor heat exchanger each and adapted to, when at least one of the plurality of indoor units is operated in a cooling mode, operate at least one of the remaining indoor units in a heating mode.

U.S. Pat. No. 4,878,357 discloses an air-conditioning apparatus including one outdoor unit having a compressor and outdoor heat exchanger and a plurality of indoor units having an indoor heat exchanger each and adapted to, when at least one of the plurality of indoor units is operated in a cooling mode, operate at least one of the remaining indoor units in a heating mode, in which case the outdoor heat exchanger is divided into a plurality of sections.

However, these conventional apparatuses simply describe a basic flow of a refrigerant for performing a simultaneous cooling/heating operation in the plurality of indoor units and no effective countermeasure is made against the generation of any refrigerant noise and vibration as caused by a change in the number of operated ones of the indoor units.

That is, the aforementioned air-conditioning apparatuses generate such refrigerant noise and vibration upon a change in the number of operated indoor units, disturbing an occupant and occupants around the unit due to the generation of discordant noises.

SUMMARY OF THE INVENTION

It is accordingly the object of the present invention to provide an air-conditioning apparatus which can prevent generation of a refrigerant noise and vibration upon a variation in the number of indoor units employed and enables an occupant or occupants in a house or a building to suffer no bad feeling.

According to the present invention, there is provided an apparatus comprising:

a compressor provided in an outdoor unit and adapted to suck, compress and discharge a refrigerant;

an outdoor heat exchanger provided in the outdoor unit to allow an exchange to be made between heat in an incoming refrigerant and heat in outdoor air;

a plurality of indoor heat exchangers each provided in the corresponding indoor unit to allow an exchange to be made between heat in an incoming refrigerant and heat in indoor air;

means, provided in the respective indoor unit, for making either one of a request for a cooling operation mode and cooling power level and a request for a heating operation mode and heating power level;

means for determining the cooling operation mode or the heating operation mode in accordance with the magnitude of a total of one or more cooling power levels requested by one or more indoor units and a total of one or more heating power levels requested by a remaining one or more indoor units;

means for, upon determination of the cooling operation mode, allowing a refrigerant which is discharged from the compressor to pass through the outdoor heat exchanger and that refrigerant which passes through the outdoor heat exchanger to flow through the one or more indoor units back into the compressor;

means for, upon determination of the cooling operation mode, allowing some stream of the refrigerant which is discharged from the compressor to pass through the one or more indoor units calling for the heating operation mode and that refrigerant which passes through the indoor unit to join a refrigerant stream or streams into the one or more indoor units calling for the cooling operation mode;

means for, upon determination of the heating operation mode, allowing the refrigerant which is discharged from the compressor to pass through one or more indoor units calling for the heating operation mode and that refrigerant which passes through the indoor unit to pass through the outdoor heat exchanger back into the compressor;

means for, upon determination of the heating operation mode, allowing some stream or streams which pass through the one or more indoor units calling for the heating operation mode to pass through the one or more indoor units calling for the cooling operation mode and that refrigerant which passes through the indoor unit to return back into the compressor;

a plurality of two-way valves, provided in a branch unit, for controlling a flow of the refrigerant into the respective indoor heat exchanger and a direction in which the refrigerant is flowed into the respective indoor heat exchanger;

a plurality of bypasses connected in parallel with the respective two-way valves and having a flow resistance each; and means for, upon opening of one or more two-way valves, allowing that bypass which corresponds to a to-be-opened two-way valve to be previously placed in fluid communication.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

One embodiment of the present invention will be explained below with reference to the accompanying drawings.

Figure 1:
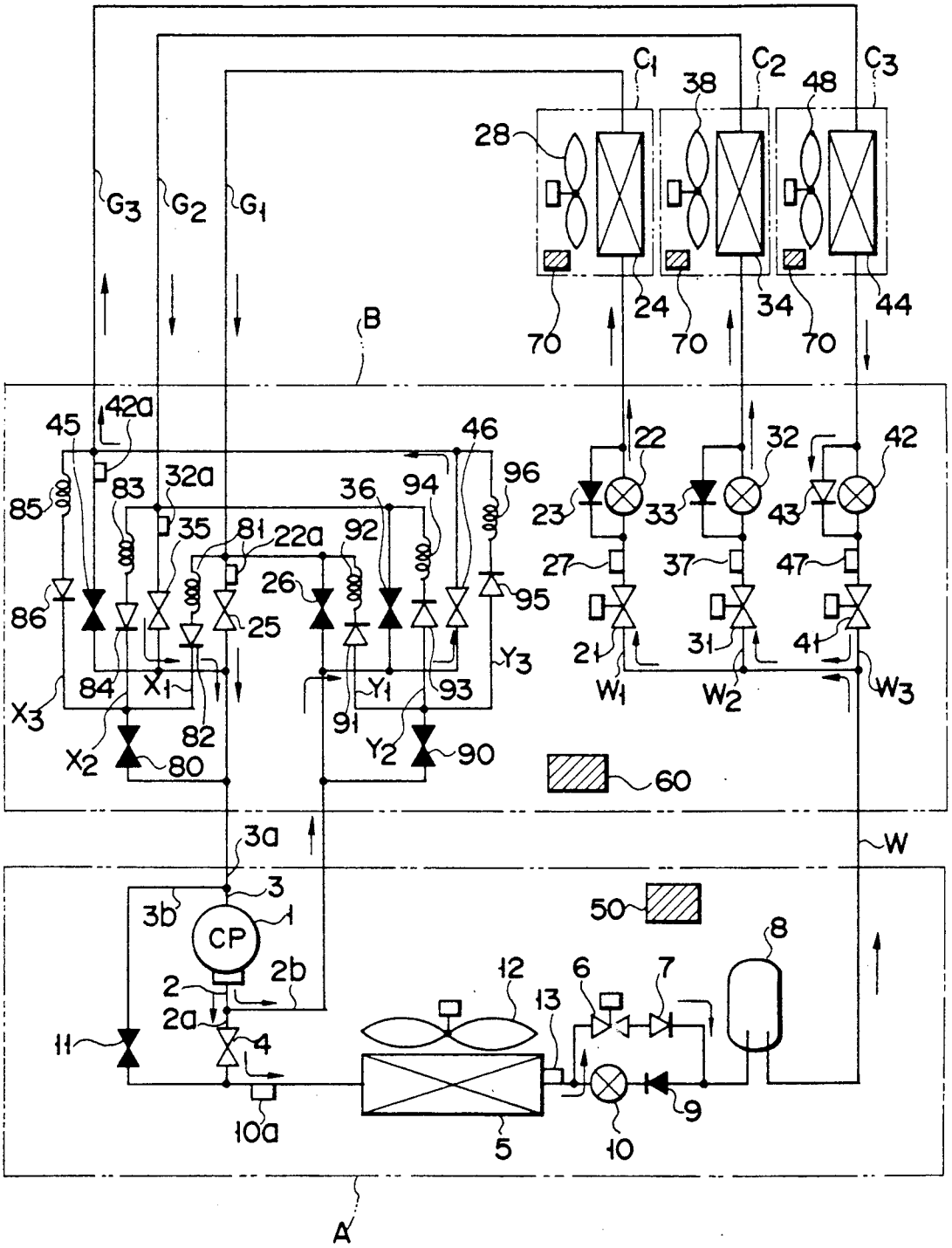
FIG. 1 is a view showing an arrangement of a refrigerating machine according to one embodiment of the present invention and a flow of a refrigerant in a cooling operation mode.

In FIG. 1, A represents an outdoor unit. A plurality of indoor units $C_1$, $C_2$ and $C_3$ are connected to the outdoor unit A via a branch unit B. with the outdoor unit A, branch unit B and indoor units $C_1$, $C_2$ and $C_3$, a refrigerating machine is provided as will be set out below.

First, the outdoor unit A includes a capacity-variable compressor 1. The compressor 1 sucks a refrigerant via a suction inlet and compresses it and discharges the compressed one from a discharge outlet.

A discharge tube 2 is connected to the discharge outlet of the compressor 1.

A suction tube 3 is connected to the suction inlet of the compressor 1.

The discharge tube 2 is branched into two discharge tubes 2*a* and 2*b*.

The suction tube 3 is branched into two suction tubes 3*a* and 3*b*.

An outdoor heat exchanger 5 is connected to the discharge tube 2*a* via a two-way valve 4 and allows an exchange to be made between incoming refrigerant heat and outdoor air heat.

A liquid tank 8 is connected to the outdoor heat exchanger 5 via a pulse motor valve (hereinafter referred to as a PMV) and a forward-direction check valve 7. A liquid-side tube W is connected to the liquid tank 8.

A forward-direction check valve 9 and expansion valve 10 are connected in a route from the liquid tank 8 to the outdoor heat exchanger 5.

The suction tube 3*a* is connected to the outdoor heat exchanger 5 via a two-way valve 11 and to the two-way valve 4.

The liquid tube W is branched into three liquid-side tubes $W_1$, $W_2$ and $W_3$.

Indoor heat exchangers 24, 34 and 44 of the indoor units $C_1$, $C_2$ and $C_3$ are connected respectively through PMVs 21, 31 and 41 and expansion valves 22, 32 and 42 to the liquid-side tubes $W_1$, $W_2$ and $W_3$. These indoor heat exchangers 24, 34 and 44 allow an exchange to be made between the inflow refrigerant heat and indoor air heat.

Forward-direction check valves 23, 33 and 43 are connected from a point between the expansion valve (22, 32, 42) and the corresponding indoor heat exchanger (22, 34, 44) to a point between the PMV (21, 31, 41) and the corresponding expansion valve (22, 32 and 42).

Gas-side tubes $G_1$, $G_2$ and $G_3$ are connected to the indoor heat exchangers 24, 34 and 44.

The gas-side tubes $G_1$, $G_2$ and $G_3$ are each branched into two branch routes.

One of the branch routes of each gas-side tube ($G_1$. $G_2$ and $G_3$) is connected to the suction tube 3*a* via a corresponding two-way valve (25, 35 and 45).

The other branch route of each gas-side tube ($G_1$, $G_2$ and $G_3$) is connected to the suction tube 2*b* via a corresponding two-way valve (26, 36 and 46).

These two-way valves 25, 35, 45, 26, 36 and 46 serves as a means for controlling a flow of a refrigerant into the indoor heat exchangers 24, 34 and 44 and its flow direction.

The outdoor unit A includes an outdoor fan 12 for circulating outdoor air through the outdoor heat exchanger 5.

A temperature sensor 13 is mounted on a tube between the outdoor heat exchanger 5 and PMV 6 and acts as a third detection means for detecting the supercooling level of the refrigerant through the outdoor heat exchanger 5.

A temperature-sensitive unit 10*a* is mounted on a tube between the two-way valves 11, 4 and the outdoor heat exchanger 5.

The temperature-sensitive unit 10*a* is a component part associated with the expansion valve 10.

The expansion valve 10 functions as a fourth detection means for detecting the difference between the temperature of the refrigerant flowing therethrough and the temperature detected at the temperature-sensitive unit 10*a*, that is, the superheating extent of the refrigerant flowing through the outdoor heat exchanger 5. The expansion valve 10 serves as a means for regulating an amount of refrigerant flowing through the outdoor heat exchanger 5 so that the detected superheating extent is set to a predetermined value.

In the branch unit B, temperature sensors 27, 37 and 47 are mounted between PMVs 21, 31 and 41 and the corresponding check valves 23, 33 and 43, respectively, and act as first detection means for detecting the supercooling extent of the refrigerant flowing respectively through the indoor heat exchangers 24, 34 and 44.

Temperature-sensitive units 22*a*, 32*a* and 42*a* are mounted on the corresponding branch tubes of the two-way valves 25, 35 and 45 of the gas-side tubes $G_1$, $G_2$ and $G_3$.

The temperature-sensitive units 22*a*, 32*a* and 42*a* are component parts associated with the expansion valves 22, 32 and 42.

The expansion valves 22, 32 and 42 serve as second detection means for detecting the difference between the temperature of the refrigerant flowing therethrough and the temperature detected at the temperature-sensitive units 22*a*, 32*a* and 42*a*, that is, the superheating extent of the refrigerant flowing through the indoor heat exchangers 24, 34 and 44. Further, the expansion valves 22, 32 and 42 work as means for regulating an amount of refrigerant flowing through the indoor heat exchangers 24, 34 and 44 so that the detected superheating extent is set to a predetermined value.

In the indoor units $C_1$, $C_2$ and $C_3$, indoor fans 28, 38 and 48 are provided in the indoor heat exchangers 24, 34 and 44 to allow indoor air to be circulated through the indoor heat exchangers 24, 34 and 44.

A bypass $X_1$ is connected to a route from the gas-side tube G1 to the suction tube 3*a* in a parallel relation to the two-way valve 25.

A bypass $X_2$ is connected to a route from the gas-side tube $G_2$ to the suction tube 3*a* in a parallel relation to the two-way valve 35.

A bypass $X_3$ is connected from the gas-side tube $G_3$ to the suction tube 3*a* in a parallel relation to the two-way valve 45.

The bypasses $X_1$, $X_2$ and $X_3$ are connected to the suction tube 3*a* via a common two-way valve 80 on their common tube.

The bypass $X_1$ includes a capillary tube 81 as a passage resistance and a check valve 82.

The bypass $X_2$ includes a capillary tube 83 as a passage resistor and a check valve 84.

The bypass $X_3$ includes a capillary tube 85 as a passage resistance and a check valve 86.

A bypass $Y_1$ is connected to a route from the gas-side tube $G_1$ to the discharge tube 2*b* in a parallel relation to the two-way valve 26.

A bypass $Y_2$ is connected to a route from the gas-side tube $G_2$ to the discharge tube 2*b* in a parallel relation to the two-way valve 36.

A bypass $Y_3$ is connected to a route from the gas-side tube $G_3$ to the discharge tube 2*b* in a parallel relation to the two-way valve 46.

The bypass $Y_1$, $Y_2$ and $Y_3$ are connected to the suction tube 2*a* via a common two-way valve 90 on their common tube.

The bypass $Y_1$ includes a check valve 91 and a capillary tube 92 as a passage resistance.

The bypass $Y_2$ includes a check valve 93 and a capillary tube 94 as a passage resistance.

The passage $Y_3$ includes a check valve 95 and a capillary tube 96 as a passage resistance.

An outdoor control section 50 is provided on the outdoor unit A and comprised of a microcomputer and its peripheral circuits.

A branch control section 60 is provided in the branch unit B and comprised of a microcomputer and its peripheral circuits.

Indoor control units, 70, 70, 70 are provided in the indoor units $C_1$, $C_2$ and $C_3$, respectively, and each comprised of a microcomputer and its peripheral circuit.

The indoor control section has the function for making either one of a cooling operation mode/cooling power level request and a heating operation mode/heating power level request.

The outdoor control section 50 and branch control section 60 perform the following functions 1 to 18 .

1 A function for determining a cooling operation mode or a heating operation mode in accordance with a total of a cooling power level or levels requested from one or more indoor units and a total of a heating power level or levels requested from a remaining one or more indoor units.

2 A function for flowing a refrigerant discharged from the compressor 1, when the cooling operation mode is determined, past the outdoor heat exchanger 5 into one or more indoor units calling for a cooling operation mode and returning it back to the compressor 1.

3 A function for flowing a refrigerant stream discharged from the compressor 1, when the cooling operation mode is determined, into one or more indoor units calling for a heating operation mode and allowing the stream of the refrigerant which is flowed through the indoor unit to join a refrigerant stream into one or more indoor units calling for the cooling operation mode.

4 A function for controlling when the cooling operation mode is determined, the frequency of a voltage coming from a later-described inverter circuit 502, in accordance with the total of the cooling power level or levels from one or more indoor units.

5 A function for controlling, when the cooling operation mode is determined, an amount of refrigerant flowing through one or more indoor units calling for the cooling operation mode, that is, the opening extent of the PMVs 21, 31 and 41, in accordance with the cooling power level or levels requested from one or more indoor units.

6 A function for first detecting, when the cooling operation mode is determined, the supercooling extent of a refrigerant flowing through one or more indoor units calling for the heating operation mode (first detecting means: temperature sensors 27, 37, 47).

7 A function for allowing an amount of refrigerant which is flowed through one or more indoor units calling for the heating operation mode, that is, an opening extent of the PMVs 21, 31 and 41, to be controlled, when the cooling operation mode is determined, so that a result of detection by the first detecting function is set to a predetermined value.

8 A function for allowing a refrigerant which is discharged from the compressor 1 to pass through one or more indoor units calling for the heating operation mode, when the heating operation mode is determined, and the refrigerant which is passed through the indoor unit to be returned back to the compressor 1 past the outdoor heat exchanger 5.

9 A function for allowing one stream of a refrigerant which is flowed through one or more indoor units calling for the heating operation mode to be passed through one or more indoor units Calling for the cooling operation mode, when the heating operation mode is determined, and the refrigerant which is passed through the indoor unit to be returned back to the compressor 1.

10 A function for allowing the frequency of a voltage which is output from the later-described inverter circuit 502 to be controlled, upon the determination of the heating operation mode, in accordance with the total of the heating power level or levels requested from one or more indoor units.

11 A function for allowing an amount of refrigerant which is flowed through one or more indoor units calling for the heating operation mode, that is, the opening extent of PMVs 21, 31 and 41, to be controlled, when the heating operation mode is determined, in accordance with the heating power level or levels requested from said one or more indoor units.

12 A function for, in the event of turning on one or more ones of the two-way valves 25, 35, 45, 26, 36 and 46, previously placing the corresponding bypass in fluid communication, that is, opening the two-way 80 or 90.

13 A function for second detecting the superheating extent of a refrigerant flowing through one or more indoor units calling for the cooling operation mode (second detecting means: expansion valves 22, 32, 42).

14 A function for regulating an amount of refrigerant flowing through one or more indoor units calling for the cooling operation mode so that a result of detection by the second detecting function is set to a predetermined value—function of the expansion valves 22, 32, 42.

15 A function for third detecting the supercooling extent of a refrigerant flowing through the outdoor heat exchanger 5, when the cooling operation mode is determined (third detecting means: temperature sensor 13).

16 A function for allowing an amount of refrigerant which is flowed through the outdoor heat exchanger 5, that is, the opening extent of PMV 6, to be controlled, when the cooling operation mode is determined, so that a result of detection by the third detecting function is set to a predetermined value.

17 A function for fourth detecting the heating power level of a refrigerant flowing through the indoor heat exchanger 5, when the heating operation mode is determined (fourth detecting means: expansion valve 10).

18 A function for regulating an amount of refrigerant flowing through the outdoor heat exchanger 5, when the heating operation mode is determined, so that a result of detection by the fourth detecting function is set to a predetermined value (means: expansion valve 10).

Figure 2:
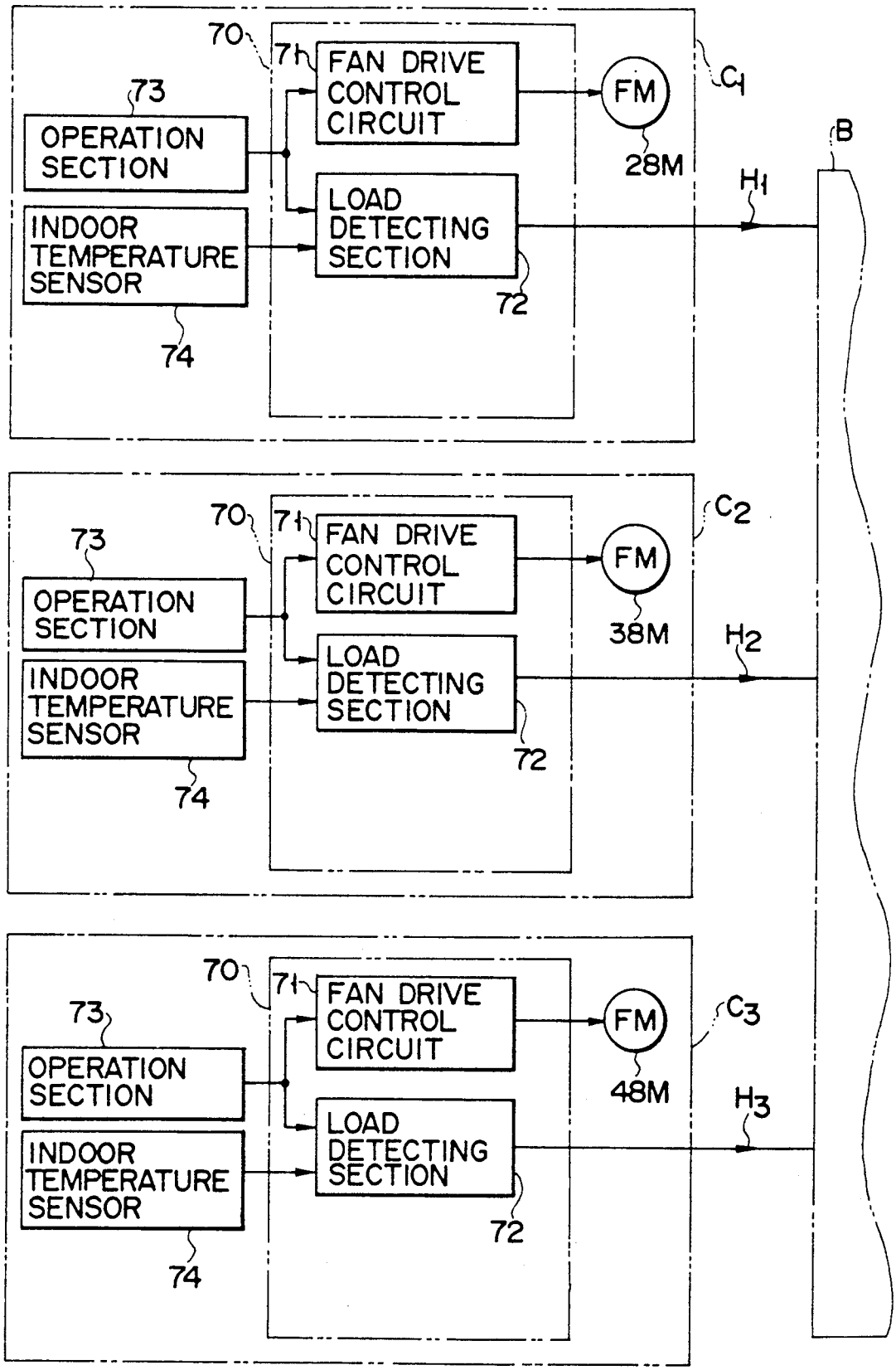
FIG. 2 is a block view showing an indoor control section of the embodiment of FIG. 1 and its peripheries.

The arrangement of the respective indoor control sections 70 and their peripheries is shown in FIG. 2.

The respective indoor control section 70 is comprised of a fan drive control circuit 71 and load detecting section 72.

The fan drive control circuit 71 in the indoor unit $C_1$ drives a motor 28M of the indoor fan 28 in accordance with the operation of an operation section 73.

The fan drive control circuit 71 in the indoor unit $C_2$ drives a motor 38M of the indoor fan 38 in accordance with the operation of an operation section 73.

The fan drive control circuit 71 in the indoor unit $C_3$ drives a motor 48M of the indoor fan 48 in accordance with the operation of an operation section 73.

The load detection section 72 in the indoor-unit $C_2$ performs the following functions 1 , 2 and 3 .

1 The section 72 sends an operation mode request as set by the operation section 73 to the branch control section 60 with the use of a signal $H_1$.

2 The section 72 detects, as a load, the difference between the indoor temperature set by the operation section 73 and the detection temperature of the indoor temperature sensor 74.

3 The section 72 sends a request for a cooling power level or a heating power level corresponding to a detected load to the branch control section 60 with the use of the aforementioned signal $H_1$.

The operating section 72 in the indoor unit $C_2$ performs the following functions and 1 , 2 and 3 .

1 The section 72 sends an operation mode request set by the operating section 73 to the branch control section 60 by a signal $H_2$.

2 The section 72 detects, as a load, the difference between the indoor temperature set by the operating section 73 and the temperature detected by the indoor temperature sensor 74.

3 The section 72 sends a request for a cooling power level or a heating power level corresponding to the detected load to the branch control section 60 by the signal $H_2$.

The load detecting section 72 in the indoor unit $C_3$ performs the following functions 1 , 2 and 3 .

1 The section 72 sends an operation mode request set by the operating section 73 to the branch control section 60 by a signal $H_3$.

2 The section 72 detects, as a load, the difference between the indoor temperature set by the operating section 73 and the temperature detected by the indoor temperature sensor 74.

3 The section 72 sends a request for a cooling power level or a heating power level corresponding to the detected load to the branch control section 60 by the signal $H_3$.

Figure 3:
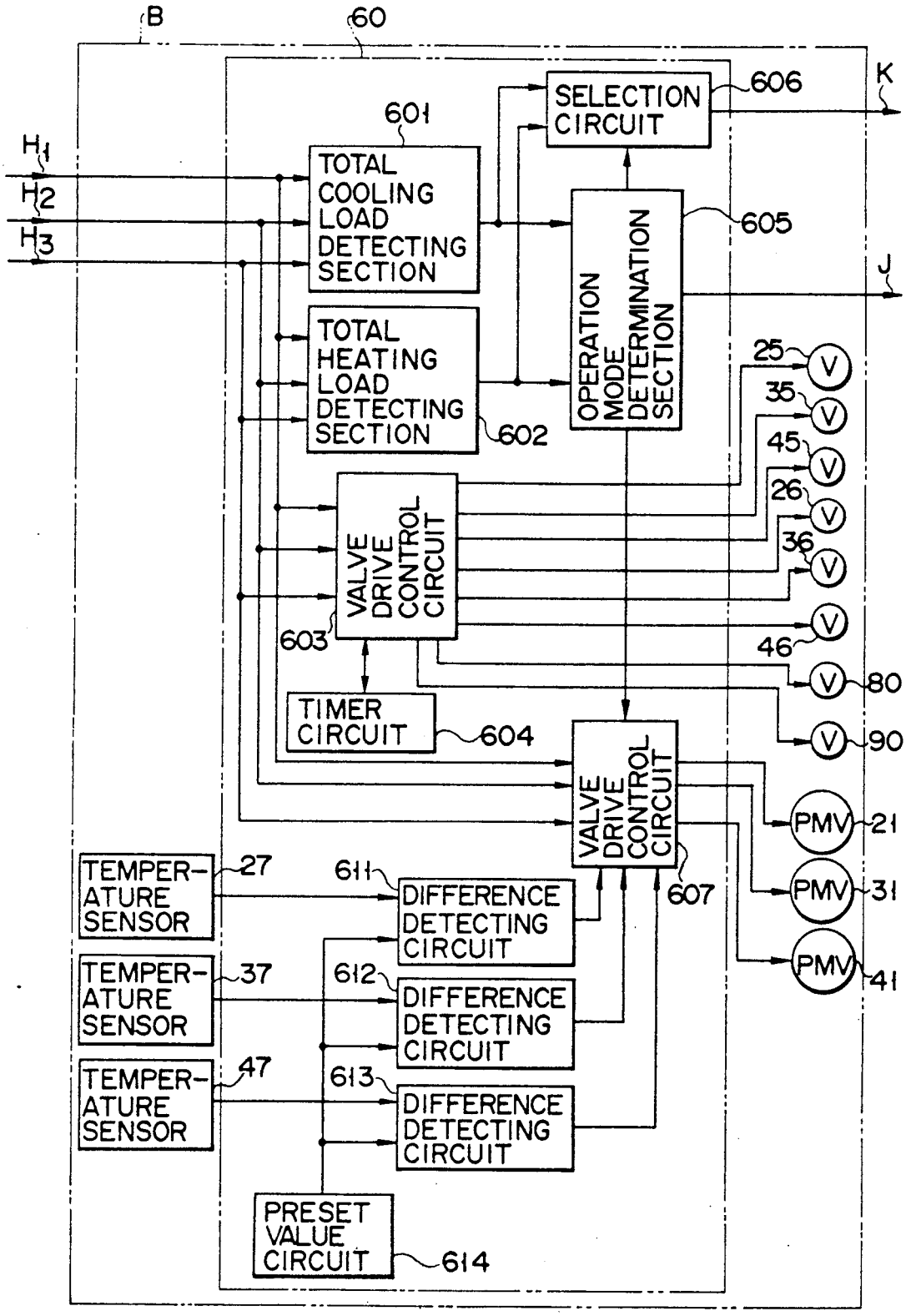
FIG. 3 is a block view showing a branch control section of the present embodiment and its peripheries.

The arrangement of the branch control section 60 and its peripheries is shown in FIG. 3.

The branch control section 60 comprises a total cooling load detecting section 601, a total heating load detecting section 602, a valve drive control circuit 603, a timer circuit 604, an operation mode determination section 605, a selection circuit 606, a valve drive control circuit 607, difference detecting circuits 611, 612 and 613 and a preset value circuit 614.

The total cooling load detecting section 601 performs the following functions 1 and 2 .

1 The section 601 determines a cooling power level request from the signals $H_1$, $H_2$ and $H_3$ of the respective indoor control sections 70.

2 The section 601 detects a total cooling power level determined.

The total heating load detecting section 602 performs the following functions 1 and 2 .

1 The section 602 determines a heating power level request from the signals $H_1$, $H_2$ and $H_3$ of the respective indoor control sections 70.

2 The section 602 detects a total heating power level determined.

A valve drive control circuit 603 performs the following functions 1 and 2 .

1 The circuit 603 determines a cooling operation mode request or a heating operation mode request from the signals $H_1$, $H_2$ and $H_3$ of the indoor control sections 70.

2 The circuit 603 controls the opening and closing of the two-way values 25, 35, 45, 26, 36 and 46 and two-way valves 80 and 90.

When, for example, the request for the cooling operation mode is made by the signal $H_1$, the two-way valves 25 and 26 are opened and closed, respectively. When the request for the cooling operation mode is made by the signal $H_2$, the two-way valves 35 and 36 are opened and closed, respectively. When the request for the cooling operation mode is made by the signal $H_3$, the two-way valves 45 and 46 are opened and closed, respectively.

When the heating operation mode is requested by the signal $H_1$, the two-way valves 25 and 26 are closed and opened, respectively. At the opening of the two-way valve 26, therefore, the two-way valve 90 is opened previously and for a period of n seconds only based on a timer count by the timer circuit 604. With the two-way valve 90 opened, the bypass $Y_1$ allows fluid communication.

When the heating operation mode is requested by the signal $H_2$, the two-way valves 35 and 36 are closed and opened, respectively. At the opening of the two-way valve 36, however, the two-way valve 90 is opened previously and for a period of n seconds only based on a timer count by the timer circuit 604. With the two-way valve 90 opened, the bypass $Y_2$ allows fluid communication.

When the heating operation mode is requested by the signal $H_3$, the two-way valves 45 and 46 are closed and opened, respectively. At the opening of the two-way valve 46, the two-way valve 90 is opened previously and for a period of n seconds only based on a timer count by the timer circuit 604. With the two-way valve 90 opened, the bypass $Y_3$ allows fluid communication.

When the heating operation mode made by the signal $H_1$ is released, the two-way valves 26 and 25 are closed and opened, respectively. The opening of the two-way valve 25 is effected so as to collect the refrigerant. At the opening of the two-way valve 25, the two-way valve 80 is opened previously and for a period of n seconds based on a timer count by the timer circuit 604. The bypass $X_1$ allows fluid communication by opening the two-way valve 80.

The two-way valves 36 and 35 are closed and opened, respectively, when a request for the heating operation mode is made by the signal $H_2$ is released. The opening of the two-way valve 35 is effected so as to collect the refrigerant. At the opening of the two-way valve 35 however, the two-way valve 80 is opened previously and for a period of n seconds based on a time count made by the timer circuit 604. The bypass $X_2$ allows fluid communication by the opening of the two-way valve 80.

When the request for the heating operation mode made by the signal $H_3$ is released, the two-way valves 46 and 45 are closed and opened respectively. The opening of the two-way valve 45 is effected so as to collect the refrigerant. At the opening of the two-way valve 45, the two-way valve 80 is opened previously and for a period of n seconds only based on a timer count made by the timer circuit 604. The bypass $X_3$ allows fluid communication by the opening of the two-way valve 80.

The operation mode determination section 605 performs the following functions 1 and 2 .

1 The section 605 determines a cooling operation mode or a heating operation mode in accordance with the value of a total of the cooling power levels detected by the total cooling load detecting section 601 and a total by the heating power levels detected by the total heating load detecting section 602.

When the value of the total of the cooling power levels is greater than that of the heating power levels, the cooling operation mode is determined if the level difference is greater than a predetermined value. If the difference level is not greater than the predetermined value, however, the section 605 determines the same operation mode as a current operation mode.

When the total of the heating power levels is greater than that of the cooling power levels, the heating operation mode is determined if the level difference is greater than the predetermined value. If the level difference is not greater than the predetermined value, the section 605 determines the same operation mode as the current operation mode.

If the current operation mode is not determined as at the start of operation, the cooling operation mode is determined.

2 The section 605 sends the contents of determination, as a signal J to the outdoor control section 50.

The selection circuit 606 performs the following functions 1 and 2 .

1 The circuit 606 sends a total cooling power level as detected by the total cooling load detecting section 601 to the outdoor control section 50 by a signal K, when the cooling operation mode is determined by the operation mode determination section 605.

2 The circuit 606 sends a total heating power level detected by the total heating load detecting section 602 to the outdoor control section 50 by the signal K, when the heating operation mode is determined by the operation mode determination section 605.

The value drive control circuit 607 controls PMVs 21, 31 and 41 and performs the following functions.

That is, the valve drive control circuit 607 performs the following functions 1 , 2 and 3 , when the cooling operation mode is determined by the operation mode determination section 605.

1 The circuit 607 determines a cooling operation mode request and a heating operation mode request from the signals $H_1$, $H_2$ and $H_3$ of the respective indoor control sections 70.

2 The circuit 607 controls the opening extent of PMV 21 corresponding to the indoor unit $C_1$ in accordance with a cooling power level requested by the indoor unit $C_1$ when a request is made, by the signal $H_1$, for the cooling operation mode.

The circuit 607 controls the opening extent of PMV 31 corresponding to the indoor unit $C_2$ in accordance with a cooling power level requested by the indoor unit $C_2$, when a request is made, by the signal $H_2$, for the cooling operation mode.

The circuit 607 controls the opening extent of PMV 41 corresponding to the indoor unit $C_3$ in accordance with a cooling power level requested by the indoor unit $C_3$, when a request is made, by the signal $H_3$, for the cooling operation mode.

3 The circuit 607 controls the opening extent of PMV 21 corresponding to the indoor unit $C_1$, upon the making of a request by the signal $H_1$ for the heating operation mode so as to allow a level difference which is detected by the difference detecting circuit 611 to be set to a zero.

The circuit 607 controls the opening extent of PMV 31 corresponding to the indoor unit $C_2$ upon the making of a request by the signal $H_2$ for the heating operation mode so as to allow a level difference which is detected by the difference detecting circuit 612 to be set to a zero.

The circuit 607 controls the opening extent of PMV 41 corresponding to the indoor unit $C_3$ upon the making of a request by the signal $H_3$ for the heating operation mode so as to allow a level difference which is detected by the difference detecting circuit 613 to be set to a zero.

The difference detecting circuit 611 detects the level difference between the temperature of the refrigerant detected by the temperature sensor 27 and a set valve of, for example, 45° C. of the preset value circuit 614.

The difference detecting circuit 612 detects the level difference between the temperature of the refrigerant detected by the temperature sensor 37 and a predetermined value of the preset value circuit 614.

The difference detecting circuit 613 detects the level difference between the temperature of the refrigerant detected by the temperature sensor 47 and a predetermined value of the preset value circuit 614.

The valve drive control circuit 607 performs the following functions 4 , 5 and 6 when the heating operation mode is determined by the operation mode determination circuit 605.

4 The circuit 607 determines a cooling operation mode request and a heating operation mode request from the signals $H_1$, $H_2$ and $H_3$ of the respective indoor control section 70.

5 The circuit 607 fully opens PMV 21 corresponding to the indoor unit $C_1$ upon the making of a request by the signal $H_1$ for the cooling operation mode.

The circuit 607 fully opens PMV 31 corresponding to the indoor unit $C_2$ upon the making of a request by the signal $H_2$ for the cooling operation mode.

The circuit 607 fully opens PMV 41 corresponding to the indoor unit $C_3$ upon the making of a request by the signal $H_3$ for the cooling operation mode.

6 The circuit 607 controls the opening extent of PMV 21, upon the making of a request by the signal $H_1$ for the heating operation mode, in accordance with the heating power level requested by that signal $H_1$.

The circuit 607 controls the opening extent of PMV 31, upon the making of a request by the signal $H_2$ for the heating operation mode, in accordance with the heating power level requested by that signal $H_2$.

The circuit 607 controls the opening extent of PMV 41, upon the making of a request by the signal $H_3$ for the heating operation mode, in accordance with the heating power level requested by the signal $H_3$.

Figure 4:
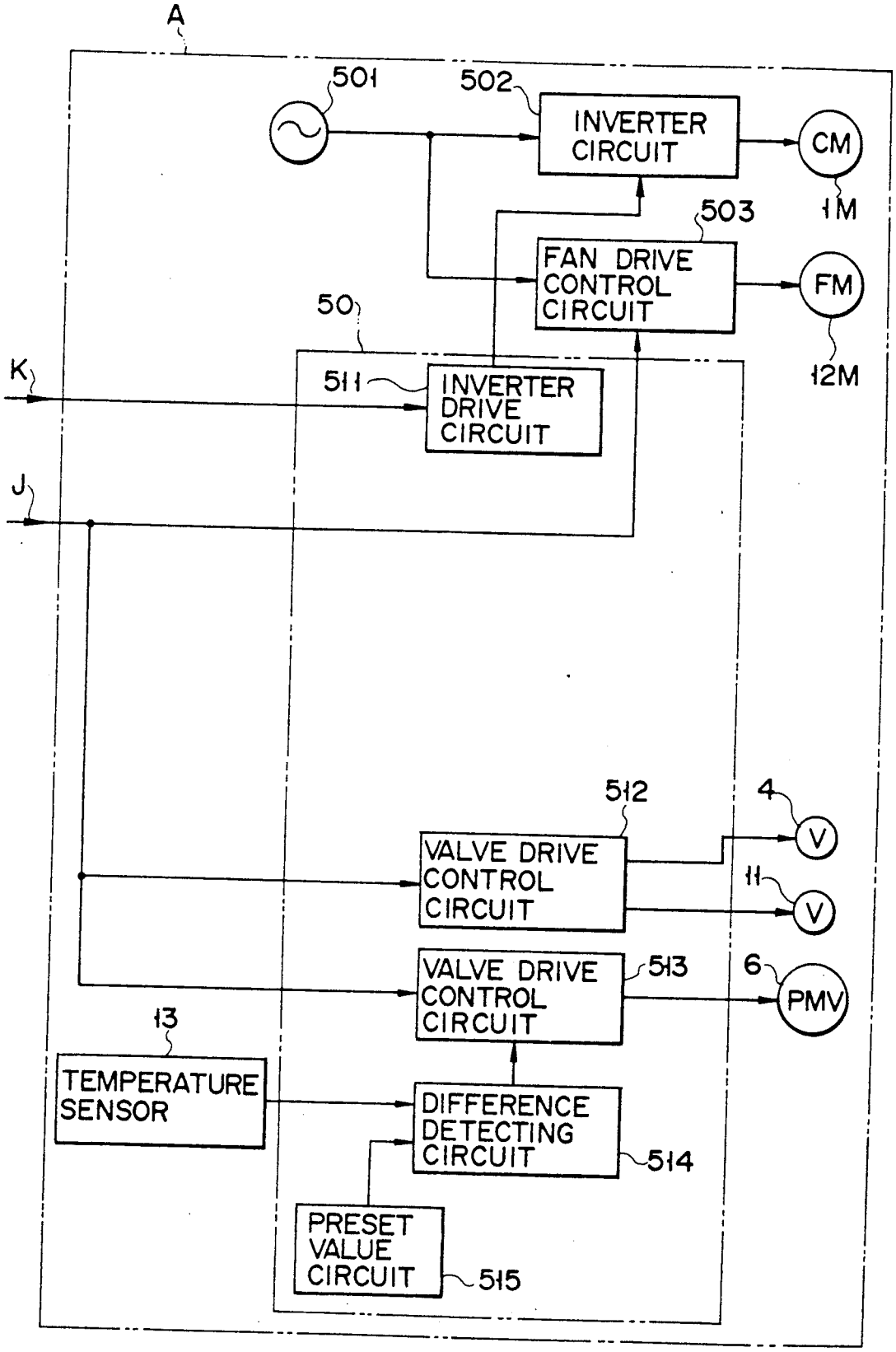
FIG. 4 is a block diagram showing an outdoor control section of the present embodiment and its peripheries.

A practical arrangement of the outdoor control section 50 and its peripheries is shown in FIG. 4.

Reference numeral 501 shows a commercial AC power supply to which are connected the aforementioned inverter circuit 502 and a fan drive control circuit 503.

The inverter circuit 502 rectifies a voltage on a power supply 501 and converts the rectified voltage to a voltage of a predetermined frequency for delivery as an output. The output voltage of the inverter circuit 502 is supplied as a drive voltage to a motor 1M of the compressor 1.

The fan drive control circuit 503 drives a motor 13M of the outdoor fan 13.

The outdoor control section 50 comprises an inverter drive circuit 511, valve drive control circuits 512, 513, a difference detecting circuit 514 and a preset value circuit 515.

The inverter drive circuit 511 performs the following functions 1 and 2 .

1 The circuit 511 determines a total of cooling power levels or a total of heating power levels requested from the respective indoor units, in accordance with a signal K of the branch control section 60.

2 The circuit 511 controls the output frequency of the inverter 502 in accordance with a value of the determined total.

The valve drive control circuit 512 performs the following functions 1 and 2 .

1 The circuit 512 opens the two-way valve 4 and closes two-way valve 11 when a signal J of the branch control section 60 represents the determination of the cooling operation mode.

2 The circuit 512 closes the two-way valve 4 and opens the two-way valve 11, respectively, when a signal J of the branch control section 60 represents the determination of the heating operation mode.

The value drive control circuit 513 controls the opening extent of PMV 6, when a signal J of the branch control section 60 represents the determination of the cooling operation, so as to allow a result of detection by the difference detection circuit 514 to be set to a zero.

The difference detecting circuit 514 detects a difference between the refrigerant temperature detected by the temperature sensor 13 and a set value of, for example, 45° C. of the preset value circuit 515.

The operation of the aforementioned circuit will be explained below.

Figure 5:
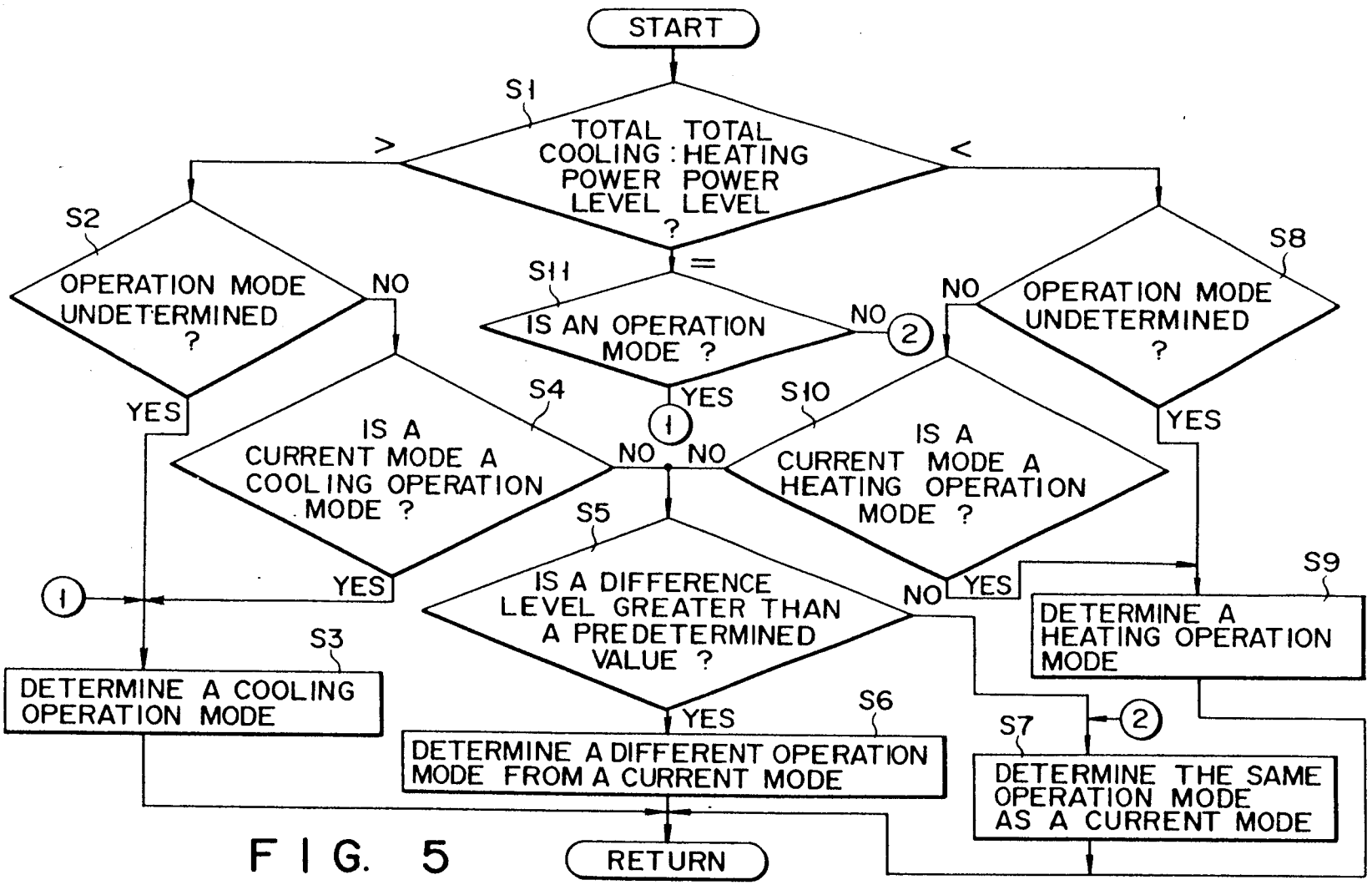
FIG. 5 is a flow chart for explaining the determination of an operation mode by the present embodiment.

The determination of the operation mode will be explained below with reference to a flow chart of FIG. 5.

A comparison is made, at step S1, between the total of cooling power levels and that of heating power levels.

Whether or not the operation mode is undetermined is ascertained if the total of the cooling power levels are greater than that of the heating power levels—step S2.

If the operation mode is undetermined (at an operation start time), a cooling operation mode is determined at step S3.

If the cooling operation mode is determined at step S4, the same cooling operation mode is determined at step S3.

If a heating operation mode is already determined, it is determined whether or not there is the difference between the total of the cooling power levels and that of the heating power levels—step S5.

If the level difference is greater than a set value, an operation mode different from a current mode, that is, the heating operation mode, is determined at step S6. If the level difference is not greater than the set value, the same operation mode as the current operation mode, that is, the cooling operation mode, is determined at step S7.

At the comparison at step S1, if the total of the heating power levels is greater than that of the cooling power levels, whether or not the operation mode is undetermined is ascertained at step S8.

When the operation mode is undetermined (=at an operation start time), the heating operation mode is determined at step S9.

If the heating operation mode is determined at step S10, the same heating operation mode is determined at step S9.

If the heating operation mode is determined, it is determined whether or not the difference between the total of the heating power levels and that of the cooling power levels is greater than the set value at step S5.

If the difference is greater than the set value, an operation mode different from the current operation mode, that is, the cooling operation mode, is determined at step S6. If the difference is not greater than the set value, the same operation mode, that is, the heating operation mode is determined at step S7.

Let it be assumed that a request is made by the indoor unit $C_1$ for the cooling operation mode, a request by the indoor unit $C_2$ for the cooling operation mode and a request by the indoor unit $C_3$ for the heating operation mode, and that the total of the cooling power levels requested is adequately greater than the total heating power levels requested.

In this case, the cooling operation mode is determined and, as shown in FIG. 1, the two-way valve 4 in the outdoor unit A is opened (indicated as an unshaded mark) and the two-way valve 11 is closed (indicated as a shaded mark).

The outdoor heat exchanger 5 is connected to the discharge tube 2*a* of the compressor 1.

In the branch unit B, PMVs 21, 31 and 41 are opened (indicated as unshaded marks), the two-way valves 25, 35 and 46 are opened (indicated as unshaded marks) and the two-way valves 26, 36 and 45 are closed (indicated as shaded marks).

The gas-side tubes $G_1$ and $G_2$ of the indoor units $C_1$ and $C_2$ by which requests are made for the cooling operation modes are connected to the suction tube 3*a* of the compressor 1. The gas-side tube $G_3$ of the indoor unit $C_3$ by which the request is made for the heating operation mode is connected to the discharge tube 2*b* of the compressor 1.

The refrigerant discharged from the compressor 1 enters the outdoor heat exchanger 5, via the two-way valve 4, where it is condensed.

The refrigerant leaving the indoor heat exchanger 5 past PMV 6, check valve 7 and liquid tank 8 and, respectively past PMVs 21 and 31 and expansion valves 22 and 32 enters the indoor units $C_1$ and $C_2$ calling for the cooling operation mode where the refrigerant is evaporated.

The refrigerant leaving the indoor units $C_1$ and $C_2$ is sucked into the compressor 1, past the two-way valve 25 and 35.

Some stream of the refrigerant which is discharged from the compressor 1 enters the indoor unit $C_3$ calling for the heating operation mode, past the two-way valve 46, where it is condensed.

The refrigerant leaving the indoor unit $C_3$ flowing past the check valve 43 and PMV 41 meets the refrigerant streams flowing the indoor units $C_1$ and $C_2$ calling for the cooling operation mode.

That is, the outdoor heat exchanger S serves as a condenser, the indoor heat exchangers 24 and 34 as evaporators, and the indoor heat exchanger 44 as a condenser.

In this case, some of absorption heat in the indoor units $C_1$ and $C_2$ is utilized as the releasing heat of the indoor unit $C_3$.

The output frequency of the inverter 502 is set in accordance with the total cooling levels requested. Therefore, the compressor 1 has a capacity enough great to afford the cooling capability of the indoor units $C_1$ and $C_2$.

At that time, the opening extents of PMVs 21 and 31 are controlled in accordance with the cooling power level requested by the indoor units $C_1$ and $C_2$ and the refrigerant is properly distributed into the indoor units $C_1$ and $C_2$. The amounts of refrigerant flowing through the indoor heat exchangers 24 and 34 are regulated by the expansion valves 22 and 32 to maintain the extent of superheating of the refrigerant constant.

The indoor units $C_3$ secures an adequate heating power level by the following control.

The temperature of the refrigerant flowing through the outdoor heat exchanger 5 is detected by the temperature sensor 13. The detected temperature corresponds to the supercooling extent.

The opening extent of PMV 6 is controlled so that the supercooling level is set to a predetermined value (45° C.).

The temperature of the refrigerant flowing from the indoor heat exchanger 44 is detected by the temperature sensor 47. The detected temperature corresponds to the extent of supercooling.

The opening extent of PMV 41 is controlled so that the supercooling power level is set to a predetermined value (45° C.).

Now let it be assumed that the heating operation mode, heating operation mode and cooling operation are requested by the indoor units $C_1$, $C_2$ and $C_3$, respectively, and that the requested total heating power level is adequately greater than the total cooling power level requested.

In this case, the heating operation mode is determined and, as shown in FIG. 1, the two-way valves 4 (indicated by a shading mark) and two-way valve 11 (indicated by an unshaded mark) in the outdoor unit A are closed and opened, respectively.

The outdoor heat exchanger 5 is connected to the suction tube 3*b* of the compressor 1.

In the branch unit B, PMVs 21, 31 and 41 (indicated by unshaded marks) are opened, the two-way valves 45, 26 and 36 (indicated by unshaded marks) are opened and the two-way valves 25, 35 and 46 (indicated by shaded marks) are closed.

The gas-side tubes $G_1$ and $G_2$ of the indoor units $C_1$ and $C_2$, respectively, calling for the cooling operation mode are connected to the suction tube 2*b* of the compressor 1. The gas-side tube $G_3$ of the indoor unit $C_3$ calling for the heating operation mode is connected to the suction tube 3*a* of the compressor 1.

Thus the refrigerant discharged from the compressor 1 enters the indoor units $C_1$ and $C_2$ calling for the heating operation mode, past the two-way valves 36 and 46, where it is condensed.

Those refrigerant streams leaving the indoor units $C_1$ and $C_2$ flow, respectively, past the check values 23 and 33, PMVs 21 and 31, liquid tank 8, check valve 9 and expansion valve 10, into the indoor heat exchanger 5 where the refrigerant is evaporated.

The refrigerant leaving the outdoor heat exchanger 5 is sucked into the compressor 1 through the two-way valve 11.

Some stream leaving the indoor units $C_1$ and $C_2$ flows past PMV 41 and expansion valve 42 into the indoor unit $C_3$ calling for the heating operation mode.

The refrigerant thus flowed is evaporated in the indoor unit $C_3$.

The refrigerant leaving the indoor unit $C_3$ passes through the two-way valve 45 and meets the refrigerant stream into the compressor 1.

That is, the indoor heat exchangers 24 and 34 serve as condensers, and the outdoor heat exchanger 5 and indoor heat exchanger 44 as evaporators.

The heat of absorption in the outdoor heat exchanger 5 and indoor heat exchanger 44 is utilized as the heat of absorption in the indoor units $C_1$ and $C_2$.

The output frequency of the inverter circuit 502 is set in accordance with the total heating power level requested. Therefore, the compressor 1 affords a capacity great enough to impart the heating power level to the indoor units $C_1$ and $C_2$ of greater load.

The opening extents of PMVs 21 and 31 are controlled in accordance with the heating levels requested by the indoor units $C_1$ and $C_2$ and the refrigerant is distributed properly into the indoor units $C_1$ and $C_2$.

The indoor unit $C_3$ secures an adequate cooling power level by the following control operation.

First, the amount of refrigerant flowing into the outdoor heat exchanger 5 is regulated by the expansion valve 10; maintaining constant the superheating extent of the refrigerant stream into the outdoor heat exchanger 5.

The amount of refrigerant stream into the indoor heat exchanger 44 is regulated by the expansion valve 42, maintaining constant the superheating extent of the refrigerant stream into the indoor heat exchanger 44.

Figure 7:
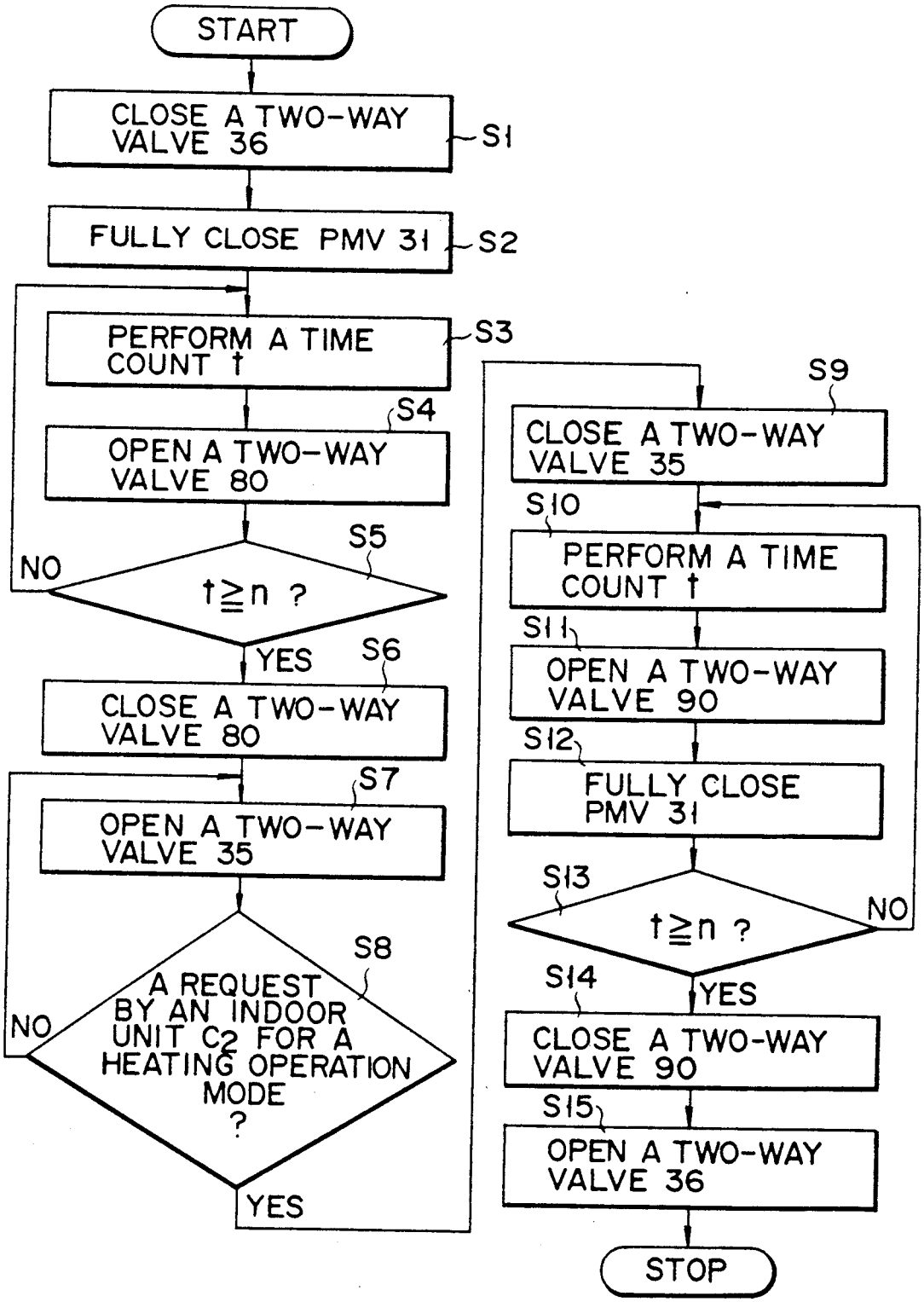
FIG. 7 is a flow chart for explaining the control of valves in a branch unit of the present embodiment.

Let it be assumed that a request made by the indoor unit $C_2$ for the heating operation mode is released by the indoor unit $C_2$. In this case, the operation will be explained below with reference to FIGS. 7 to 9.

Figure 8:
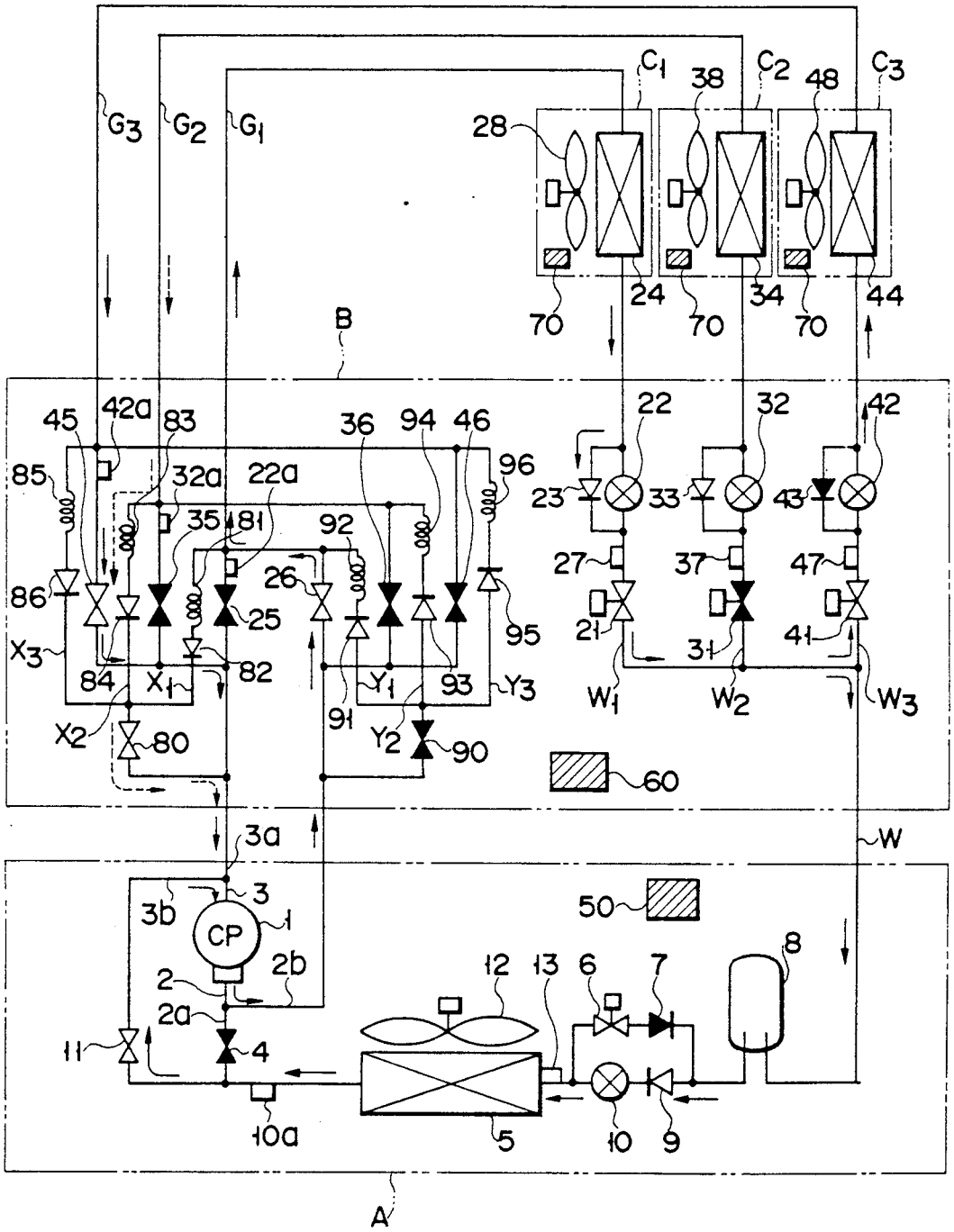
FIG. 8 is a view showing a flow of a refrigerant in the operation of less indoor units in the present embodiment.

As shown in FIG. 8, the two-way valve 36 is closed (step S1), PMV 31 is fully closed (step S2) and a refrigerant stream into the indoor heat exchanger 34 is interrupted.

At this time, it is necessary to open the two-way valve 35 so that the refrigerant stream into the indoor heat exchanger 34 may be collected, but the two-way valve 80 is opened both before the opening of the two-way valve 35 and for a period of n seconds based on the timer count t by the timer circuit 604—steps S3, S4 and S5. The bypass $X_2$ allows fluid communication through the opening of the two-way valve 80.

With the bypass $X_2$ thus communicated, the refrigerant of the gas-side tube $G_2$ flows into the suction tube 3*a*, while undergoing a flow resistance at the capillary tube 83. When this is done, a pressure balance is created across both ends of the two-way valve 35.

Figure 9:
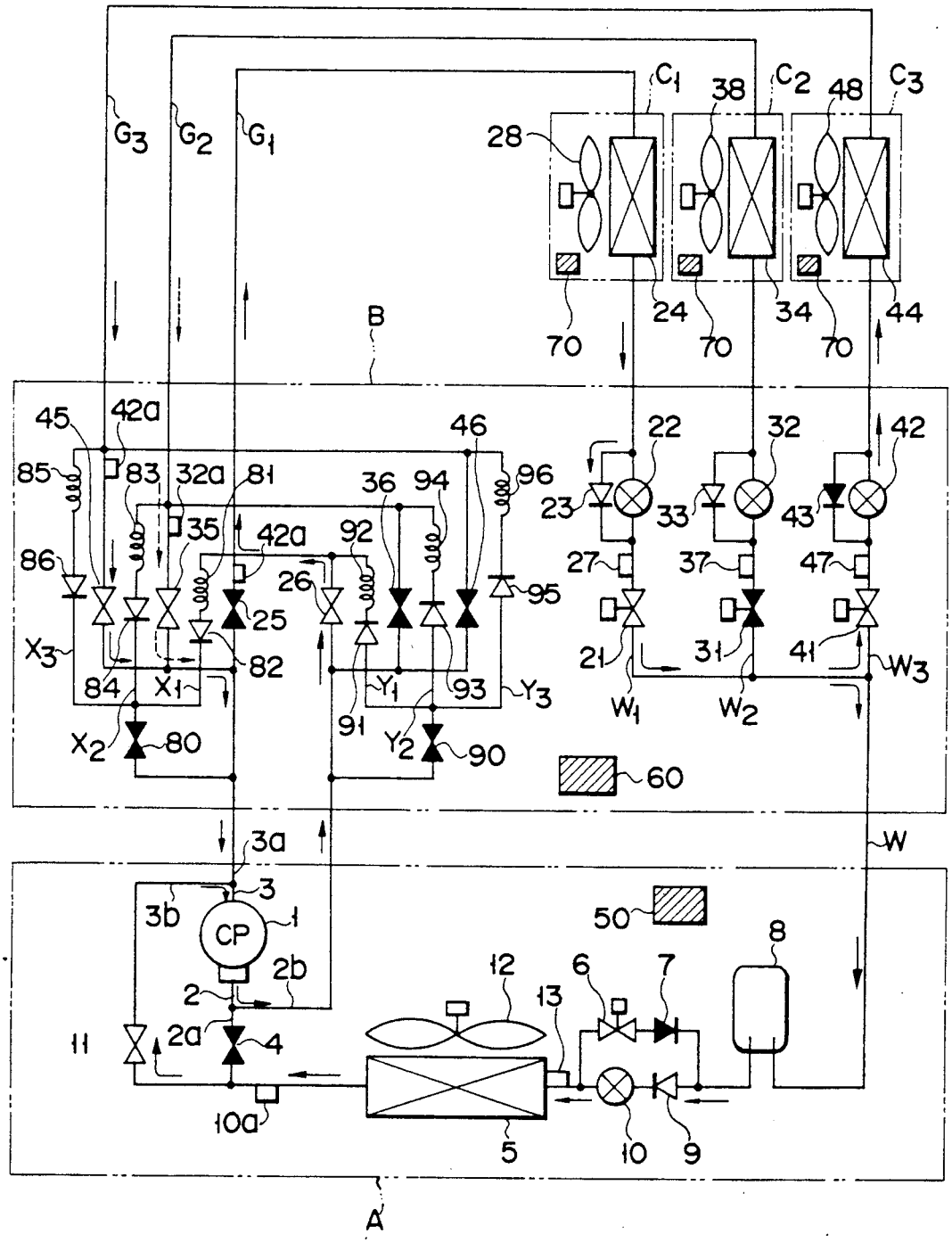
FIG. 9 is a view showing a flow of a refrigerant in the operation of less indoor units in the present embodiment.

After lapse of n seconds following the opening of the two-way valve 80, the two-way valve 80 is closed (step S6) and two-way valve 35 is opened (step S7), as shown in FIG. 9.

At this time, the refrigerant of the gas-side tube $G_2$ passes through the two-way valve 35, but no sudden refrigerant flow occurs since a pressure balance is created across both the ends of the two-way valve 35. This prevents the generation of a greater refrigerant noise and vibration.

Through the opening of the two-way valve 35, the refrigerant in the indoor heat exchanger 34 and that in gas-side tube $G_2$ are sucked into the compressor 1, preventing retention of a liquid refrigerant.

Thus the suction of the liquid refrigerant into the compressor 1, that is, a "liquid-back" phenomenon can be prevented, prolonging the life of the compressor 1.

With the two-way valve 80 opened, the bypasses $X_1$ and $X_2$ allow fluid communication each, but there arises no vacuum action by the capillary tubes 81 and 85.

Then let it be assumed that a request is made by the indoor unit $C_2$ for the heating operation mode—step S8.

Figure 10:
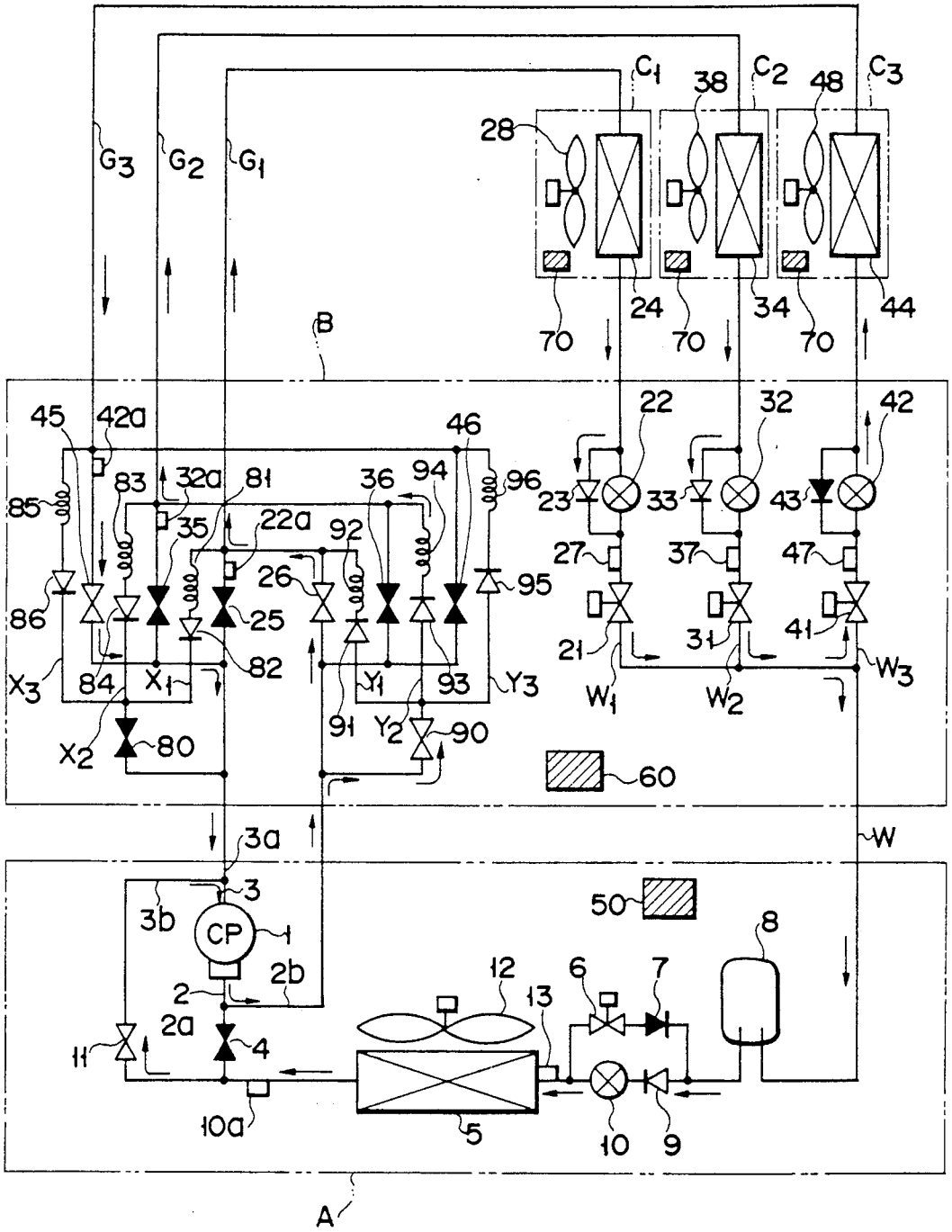
FIG. 10 is a view showing a flow of a refrigerant in the operation of more indoor units in the present embodiment.

In this case, the two-way valve 35 is closed (step S9), as shown in FIG. 10.

In order for the refrigerant to flow into the indoor heat exchanger 34, the two-way valve 36 has to be opened, but before the opening of that valve the two-way valve 90 is opened by n seconds based on a timer count t by the timer circuit 604 and, at the same time, PMV 31 is fully opened—steps S10, S11, S12 and S13.

With the two-way valve 90 opened, the bypass $Y_2$ allows fluid communication.

With the bypass $Y_2$ thus communicated, the refrigerant in the discharge tube 2*b* enters the gas-side tube $G_2$ while undergoing a flow resistance at the capillary tube 94. By so doing, a pressure balance is established across both ends of the two way valve 36.

Figure 6:
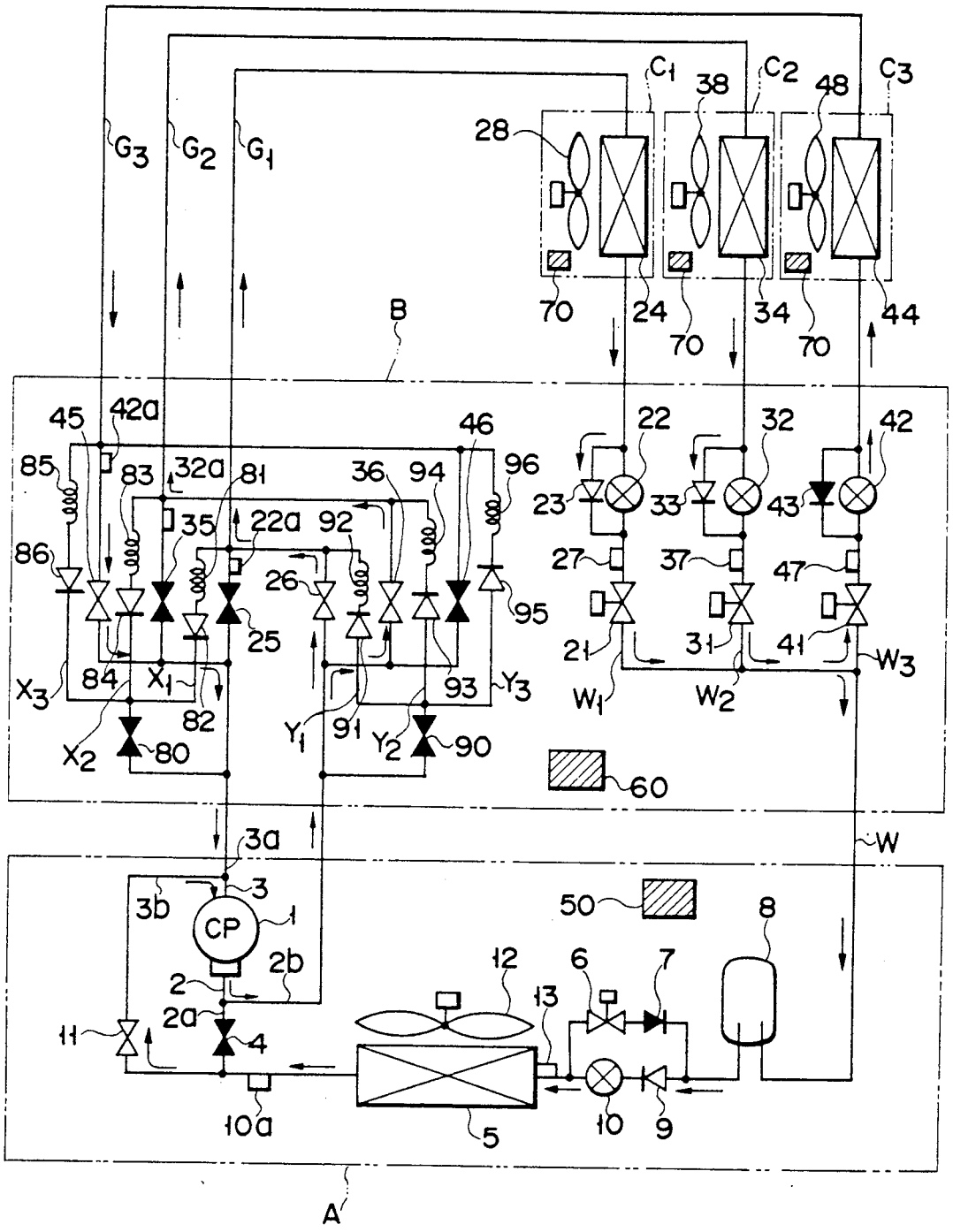
FIG. 6 is a view showing a refrigerant flow in a heating operation mode of the present embodiment.

After lapse of n seconds following the opening of the two-way valve 90, as shown in FIG. 6, the two-way valve 90 is closed (step S14) and two-way valve 36 is opened (step S15).

At that time, the refrigerant in the discharge tube 2*b* passes through the two-way valve 36, but no sudden refrigerant flow occurs because the pressure balance is created across both the ends of the two-way valve 36. This causes no generation of any greater refrigerant noise and vibration.

With the two-way valve 36 opened, the refrigerant flows into the indoor heat exchanger 34, restarting the heating operation of the indoor unit $C_2$.

At the same time, the opening extent of PMV 31 is controlled in accordance with the heating power level requested by the indoor unit $C_2$.

With the two-way valve 90 opened, the bypasses $Y_1$ and $Y_3$ allow fluid communication, but no problem arises due to a vacuum pressure action by the capillary tubes 92 and 96.

Since the refrigerant noise and vibration are not generated as set forth above, the occupant and occupants in the house or the building have more comfortable feeling.

Further, the fluid communication and blocking of the three bypasses $X_1$, $X_2$ and $X_3$ are handled by one two way valve 80 and, at the same time, the fluid communication and blocking of the bypasses $Y_1$, $Y_2$ and $Y_3$ are handled by one two-way valve 90, preventing the use of any complex, high-cost construction.

Although, in the aforementioned embodiment, the fluid communication of the bypass has been explained in conjunction with stopping and restarting of the indoor unit $C_2$, it can equally be applied to the stopping and restarting of the indoor units $C_1$ and $C_3$.

Although the fluid communication of the bypass has been explained in conjunction with the heating operation mode, the fluid communication of the bypass is similarly effected in conjunction with stopping and restarting the indoor unit on the heating side.

Although the indoor units have been explained as being three in number, any other number of indoor units may be employed.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air-conditioning apparatus having indoor units connected to one outdoor unit via one branch unit, comprising:

a compressor provided in the outdoor unit and adapted to suck, compress and discharge a refrigerant;

an outdoor heat exchanger provided in the outdoor unit to allow an exchange to be made between heat in an incoming refrigerant and heat in outdoor air;

a plurality of indoor heat exchangers each provided in the corresponding indoor unit to allow an exchange to be made between heat in an incoming refrigerant and heat in indoor air;

means, provided in the respective indoor unit, for making either one of a request for a cooling operation mode and cooling power level and a request for a heating operation mode and heating power level;

means for determining the cooling operation mode or the heating operation mode in accordance with the magnitude of a total of one or more cooling power levels requested by one or more indoor units and a total of one or more heating power levels requested by a remaining one or more indoor units;

means for, upon determination of the cooling operation mode, allowing a refrigerant which is discharged from the compressor to pass through the outdoor heat exchanger and that refrigerant which passes through the outdoor heat exchanger to flow through the one or more indoor units calling for the cooling operation mode and returning it back into the compressor;

means for, upon determination of the cooling operation mode, allowing some stream of the refrigerant which is discharged from the compressor to pass through the one or more indoor units calling for the heating operation mode and that refrigerant which passes through the indoor unit to join a refrigerant stream or streams into the one or more indoor units for calling for the cooling operation mode;

means for, upon determination of the heating operation mode, allowing the refrigerant which is discharged from the compressor to pass through one or more indoor units calling for the heating operation mode and that refrigerant which passes through the indoor unit to pass through the outdoor heat exchanger back into the compressor;

means for, upon determination of the heating operation mode, allowing some stream or streams which pass through the one or more indoor units calling for the heating operation mode to pass through the one or more indoor units calling for the cooling operation mode and that refrigerant which passes through the indoor unit to return back into the compressor;

a plurality of two-way valves, provided in the branch unit, for controlling a flow of the refrigerant into the respective indoor heat exchanger and a direction in which the refrigerant is flowed into the respective indoor heat exchanger;

a plurality of bypasses connected in parallel with the respective two-way valves and having a flow resistance each; and means for, upon opening of one or more two-way valves, allowing that bypass which corresponds to a to-be-opened two-way valve to be previously placed in fluid communication.

2. An apparatus according to claim 1, wherein said flow resistance is provided by a capillary tube.

3. An apparatus according to claim 1, further comprising:

an inverter circuit, provided in the outdoor unit, for outputting a voltage of a predetermined frequency for driving the compressor;

means for, upon determination of a cooling operation mode, allowing the frequency of a voltage which is output from said inverter circuit to be controlled in accordance with the total of the cooling power level or levels requested by one or more indoor units;

means for, upon determination of a heating operation mode, allowing the frequency of a voltage which is output from the inverter circuit to be controlled in accordance with the total of the heating power level or levels requested by one or more indoor units;

means for, upon determination of a cooling operation mode, allowing a refrigerant stream or streams which pass through said one or more indoor units calling for the cooling operation mode to be controlled in accordance with the cooling power level or levels requested by the one or more indoor units;

first detecting means for, upon determination of a cooling operation mode, detecting an supercooling extent of a refrigerant stream or streams flowing through the one or more indoor units calling for a heating operation mode;

means for, upon determination of a cooling operation mode, allowing a stream or streams which flow through the one or more indoor units calling for a heating operation mode to be controlled so as to set a result of detection by said first detecting means to a predetermined value;

means for, upon determination of a heating operation mode, allowing a stream or streams which flow through the one or more indoor units calling for a heating operation mode to be controlled in accordance with a heating power level or levels requested by the one or more indoor units;

second detecting means for detecting an superheating extent of a stream or streams flowing through the one or more indoor units calling for the cooling operation mode; and means for enabling a stream or streams flowing through the one or more indoor units calling for the cooling operation mode to be controlled so as to set a result of detection by the second detecting means to be a predetermined value.

4. An apparatus according to claim 3, wherein said first detecting means is comprised of a temperature sensor.

5. An apparatus according to claim 3, wherein said means for controlling the stream of the refrigerant so as to set a result of detection by the first detecting means to a predetermined value is comprised of a pulse motor valve.

6. An apparatus according to claim 3, wherein said detecting means is comprised of an expansion valve.

7. An apparatus according to claim 6, wherein said expansion valve serves also as means for regulating an amount of refrigerant so as to set a result of detection by said second detecting means to a predetermined value.

8. An apparatus according to claim 3, further comprising:

third detecting means for, upon determination of a cooling operation mode, detecting the supercooling extent of a refrigerant flowing through the outdoor heat exchanger;

means for, upon determination of a cooling operation mode, controlling an amount of refrigerant flowing into the outdoor heat exchanger so as to set a result of detection by the third detecting means to a predetermined value;

fourth detecting means for, upon determination of a heating operation mode, detecting the superheating extent of the refrigerant flowing through the outdoor heat exchanger; and means for, upon determination of a heating operation mode, regulating an amount of refrigerant flowing through the outdoor heat exchanger so as to set a result of detection by the fourth detecting means to a predetermined value.

9. An apparatus according to claim 8, wherein said third detecting means is comprised of a temperature sensor.

10. An apparatus according to claim 8, wherein said means for controlling an amount of refrigerant so as to set a result of detection by the third detection means is comprised of a pulse motor valve.

11. An apparatus according to claim 8, wherein said fourth detecting means is comprised of an expansion valve.

12. An apparatus according to claim 11, wherein said expansion valve serves as means for regulating an amount of refrigerant so as to set a result of detection by said fourth detecting means to a predetermined value.

* * * * *